US011078872B2

(12) United States Patent
Takemoto et al.

(10) Patent No.: US 11,078,872 B2
(45) Date of Patent: Aug. 3, 2021

(54) ENGINE WITH EGR DEVICE

(71) Applicant: KUBOTA Corporation, Osaka (JP)

(72) Inventors: Yoshikazu Takemoto, Sakai (JP); Hideyuki Goto, Sakai (JP); Takahito Hamasaki, Sakai (JP); Kentaro Nagai, Sakai (JP); Tomoya Akitomo, Sakai (JP); Kumiko Sakaguchi, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 168 days.

(21) Appl. No.: 16/202,209

(22) Filed: Nov. 28, 2018

(65) Prior Publication Data

US 2019/0203669 A1 Jul. 4, 2019

(30) Foreign Application Priority Data

Dec. 28, 2017 (JP) ..... JP2017-253634

(51) Int. Cl.

| | |
|---|---|
| ***F02M 26/22*** | (2016.01) |
| ***F02M 26/41*** | (2016.01) |
| ***F02M 26/13*** | (2016.01) |
| ***F28D 7/10*** | (2006.01) |
| ***F02M 26/11*** | (2016.01) |
| ***F28D 21/00*** | (2006.01) |
| ***F28F 1/06*** | (2006.01) |

(Continued)

(52) U.S. Cl.

CPC ..... *F02M 26/22* (2016.02); *F01P 3/20* (2013.01); *F02M 26/11* (2016.02); *F02M 26/41* (2016.02); *F28D 7/106* (2013.01); *F28D 21/0003* (2013.01); *F28F 1/025* (2013.01); *F28F 1/06* (2013.01); *F01P 2060/00* (2013.01)

(58) Field of Classification Search

CPC ..... F02M 26/13; F02M 26/22; F02M 26/41; F28D 7/106

USPC ..... 123/568.12

See application file for complete search history.

(56) References Cited

U.S. PATENT DOCUMENTS 6,513,506 B1 * 2/2003 Ito ..... F02F 1/243 123/193.5
2012/0085300 A1 * 4/2012 Asano ..... F02M 26/12 123/41.82 R (Continued)

FOREIGN PATENT DOCUMENTS

DE 102005041732 A1 3/2007
DE 102005049462 A1 5/2007

(Continued)

OTHER PUBLICATIONS

Extended European Search Report dated Jun. 3, 2019 in EP Application No. 18200322.8.

*Primary Examiner* — Phutthiwat Wongwian
*Assistant Examiner* — Arnold Castro
(74) *Attorney, Agent, or Firm* — Panitch Schwarze Belisario & Nadel LLP

(57) ABSTRACT

An engine with an EGR device includes an engine case, and an EGR pipe that introduces an EGR gas into an intake path. The EGR pipe is arranged to pass through an inside of the engine case. A part of the EGR pipe in the engine case is arranged to face a cooling water path in the engine case. The engine case is defined by a cylinder head. The cooling water path is arranged to surround a whole circumference of the EGR pipe.

5 Claims, 6 Drawing Sheets

(51) Int. Cl.
*F28F 1/02* (2006.01)
*F01P 3/20* (2006.01)

(56) References Cited

U.S. PATENT DOCUMENTS

| | | | | |
|---|---|---|---|---|
| 2016/0186704 | A1* | 6/2016 | Murotani | F02M 26/28 123/568.12 |
| 2019/0072056 | A1* | 3/2019 | Yoon | F02M 26/28 |
| 2019/0203669 | A1* | 7/2019 | Takemoto | F01P 3/20 |

FOREIGN PATENT DOCUMENTS

| | | | |
|---|---|---|---|
| EP | 2573378 | A1 | 3/2013 |
| JP | 2010-236397 | A | 10/2010 |
| JP | 2014-190171 | A | 10/2014 |

* cited by examiner

ENGINE WITH EGR DEVICE

CROSS-REFERENCE TO RELATED APPLICATION

This application claims priority under 35 U.S.C. § 119(b) to Japanese Application No. 2017-253634, filed Dec. 28, 2017, the disclosure of which is incorporated by reference herein in its entirety.

BACKGROUND OF THE INVENTION

(1) Field of the Invention

The present invention relates to an engine with an EGR device.

(2) Description of Related Art

In an engine with an EGR device, a part of the exhaust gas is returned as an EGR (Exhaust Gas Recirculation) gas to an intake path such as an intake manifold and then sucked again.

A conventional engine with an EGR device adopts a structure that arranges an EGR pipe through which the EGR gas flows, at an intake side so as to bypass an outer side of a cylinder head in an engine case. For example, an EGR pipe that communicates an exhaust manifold and an intake manifold is arranged to bypass an outer side of a cylinder head.

SUMMARY OF THE INVENTION

In the conventional engine with the EGR device, since the EGR pipe is arranged to pass through an outer side of an engine, a whole size of the engine is disadvantageously made large. Since the EGR pipe becomes high in temperature, a gap for heat dissipation should be secured around the EGR pipe, and therefore the whole size needs to be increased. Further, in an engine layout, the EGR pipe is arranged to pass through the outer side of the engine at a side of a flywheel, and thereby an air cooling effect by cooling air is hardly obtained.

An object of the present invention is to provide an engine with an EGR device in which an EGR pipe is cooled easily and a length of the engine is suppressed to be increased by totally improving a structure of an engine case or an arrangement of the EGR pipe.

An engine with an EGR device according to the present invention includes an engine case, and an EGR pipe that introduces an EGR gas into an intake path, the EGR pipe being arranged to pass through an inside of the engine case. A part of the EGR pipe in the engine case is arranged to face a cooling water path in the engine case.

According to the present invention, since the EGR pipe is arranged to pass through the inside of the engine case, a length of the engine can be made short compared to a configuration in which the EGR pipe is arranged at an outside. Further, since the EGR pipe is arranged to face the cooling water path in the engine case, the EGR pipe can be cooled by the cooling water. Consequently, the EGR pipe that becomes high in temperature can be cooled efficiently by using an existing component.

As a result, the engine with the EGR device in which an EGR pipe is cooled easily and a length of the engine is suppressed to be increased by totally improving a structure of an engine case or an arrangement of the EGR pipe can be provided.

BRIEF DESCRIPTION OF THE DRAWINGS

FIG. 4A is a front view seen from an arrow X in FIG. 3 and FIG. 4B is a cross-sectional view taken along line Y-Y in FIG. 3;

DETAILED DESCRIPTION OF PREFERRED EMBODIMENTS

Hereinafter, embodiments of an engine with an EGR device according to the present invention formed as an industrial engine will be described with reference to drawings. Here, an engine case k includes a cylinder head 2, a cylinder portion 1A, and the like. Further, a side of an exhaust manifold 4 of the engine case k is defined as a left side, and a side of an intake manifold 5 of the engine case k is defined as a right side.

Figure 6:
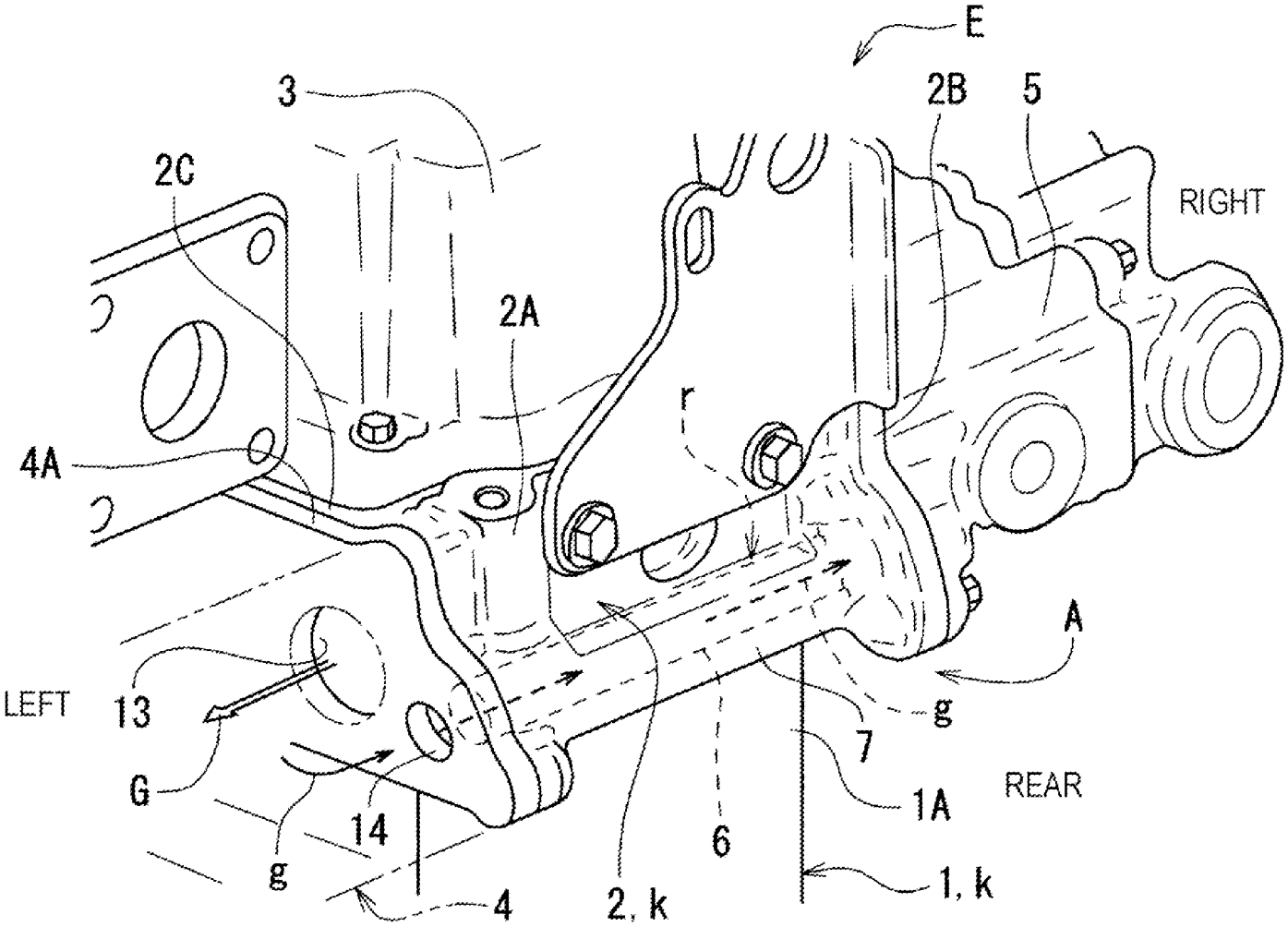
FIG. 6 is a schematic perspective view illustrating the end portion of the cylinder head provided with the EGR pipe.

As shown in FIG. 6, in a vertical industrial engine E, the cylinder head 2 is mounted on the cylinder portion 1A served as an upper portion of a cylinder block 1, and a cylinder head cover 3 is mounted on the cylinder head 2. The exhaust manifold 4 is mounted to one side in a left-right direction of the cylinder head 2, and the intake manifold 5 is mounted to the other side in the left-right direction of the cylinder head 2.

An EGR device A, which returns a part of an exhaust gas as an EGR gas into an intake path, is installed in the industrial engine E. As shown in FIG. 6, the EGR device A includes an EGR pipe 6 that communicates the exhaust manifold 4 and the intake manifold 5, and an EGR cooling mechanism r that can cool the EGR pipe.

The EGR pipe 6 is arranged to pass through an inside of the cylinder head 2 served as one example of the engine case k. An expanded case portion 7 (one example of an expanded portion), which is expanded toward an outer side, is formed so as to house the EGR pipe 6, on an case end portion 2A formed as an end portion in a front-rear direction of the cylinder head 2. Here, in FIG. 6, a reference sign 4A indicates a mount base, which is a part of the exhaust manifold 4, to mount the exhaust manifold 4 to the cylinder head 2 by a bolt.

Figure 1:
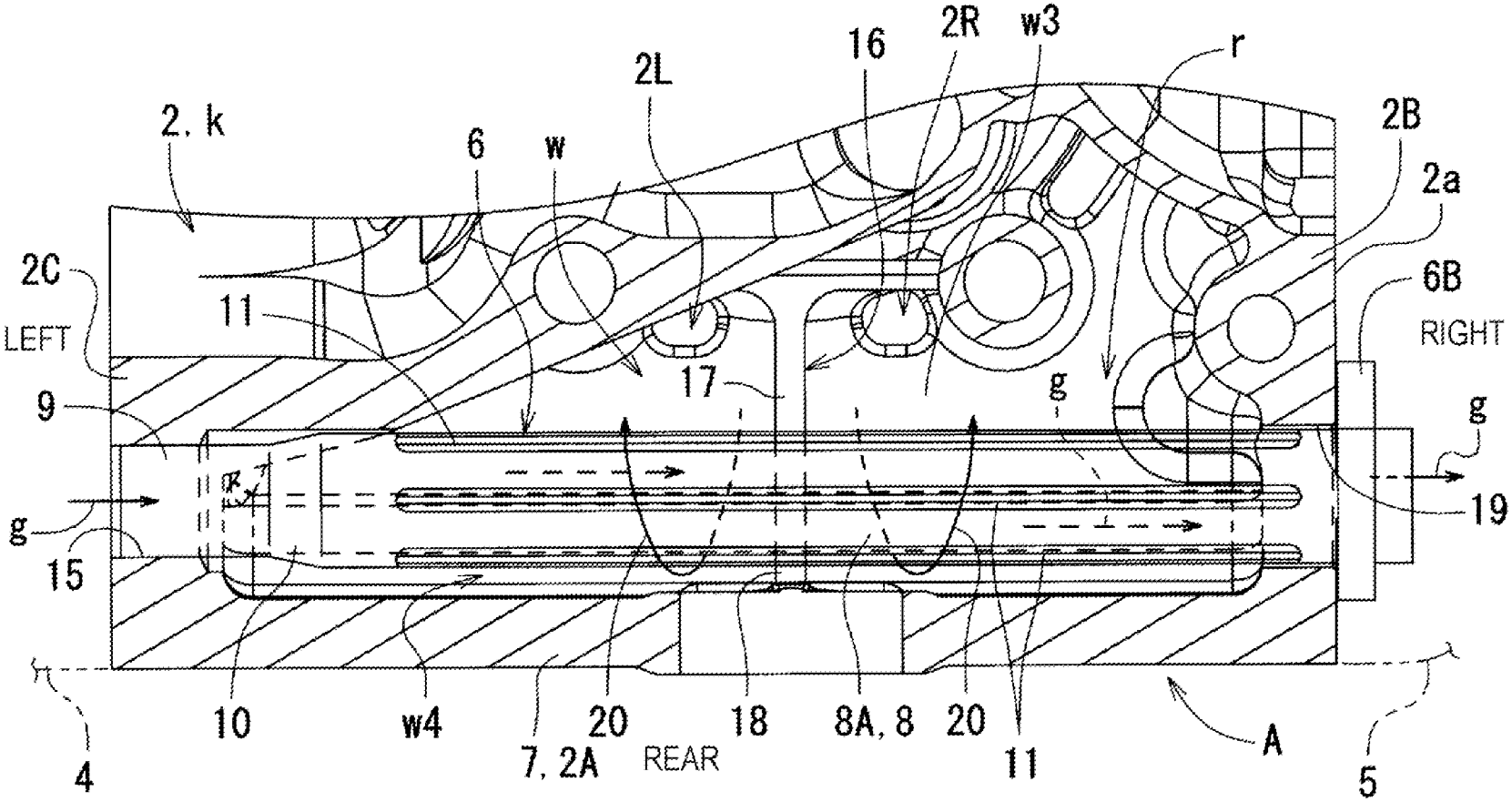
FIG. 1 is a lateral cross-sectional view of an end portion of a cylinder head illustrating a structure around an EGR pipe.
Figure 2:
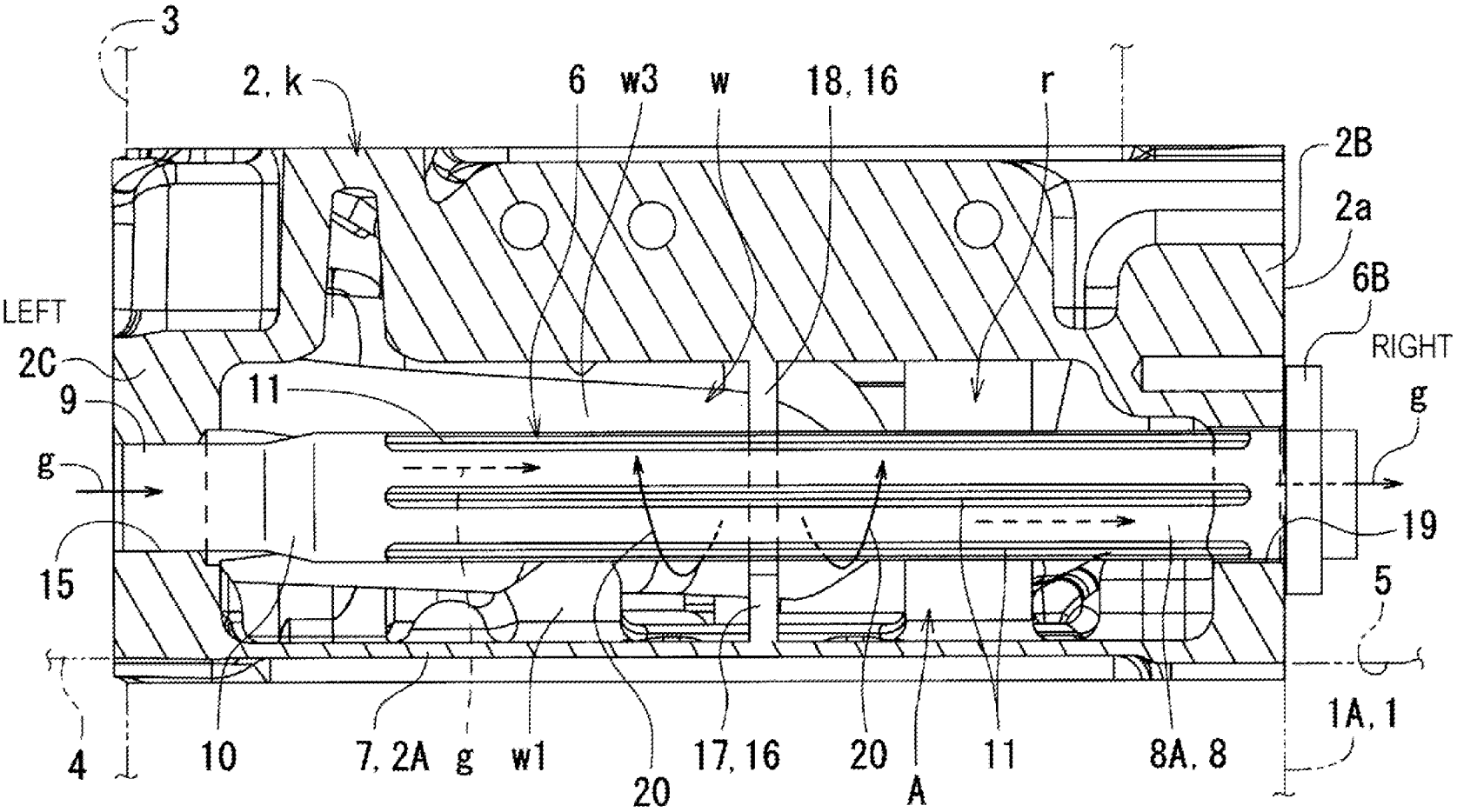
FIG. 2 is a vertical cross-sectional view of the end portion of the cylinder head illustrating the structure around the EGR pipe.
Figure 3:
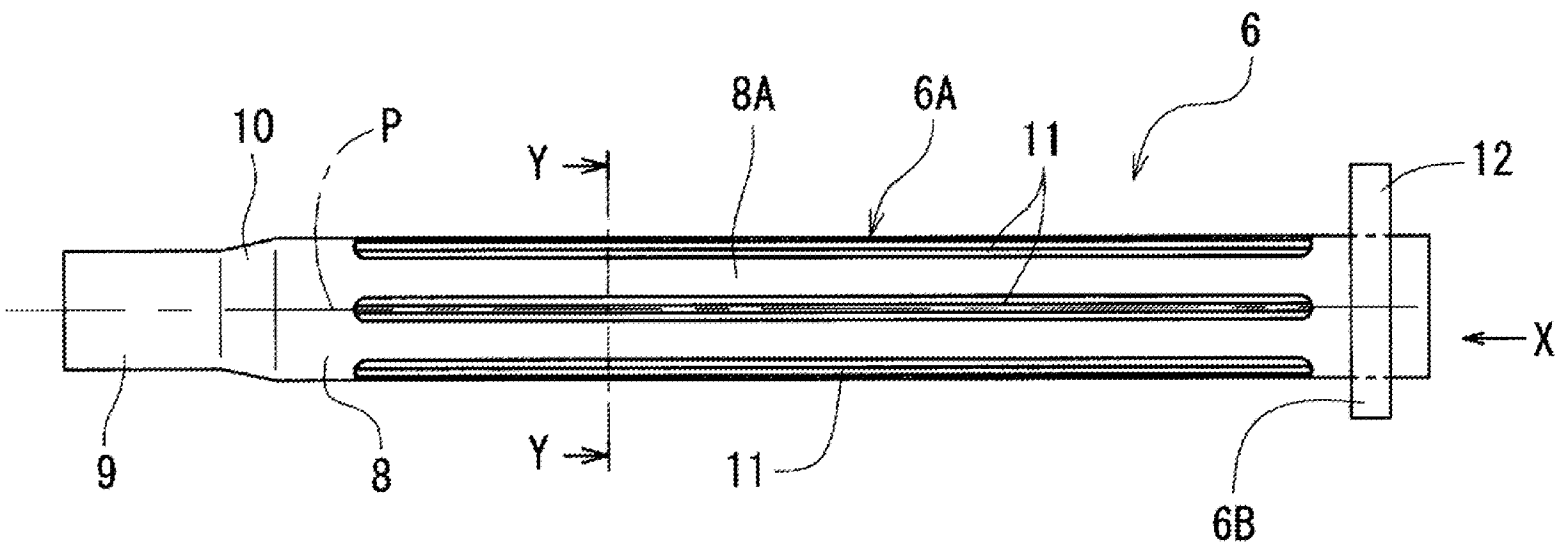
FIG. 3 is a side view illustrating the EGR pipe.

As shown in FIG. 1 to FIG. 3, the EGR pipe 6 includes a main pipe 6A, and a mount flange 6B fixed to the main pipe 6A.

The main pipe 6A includes a base pipe portion 8, a small diameter portion 9 having a diameter formed to be slightly small, the small diameter portion 9 being formed at a proximal side of the base pipe portion 8, and a tapered pipe portion 10 formed between the base pipe portion 8 and the small diameter portion 9. The base pipe portion 8 includes a deformed pipe portion 8A having a complicated cross section. The deformed pipe portion 8A is formed at a most part of the base pipe portion 8 in a longitudinal direction of the base pipe portion 8 excluding both end portions of the base pipe portion 8.

Figure 4A:
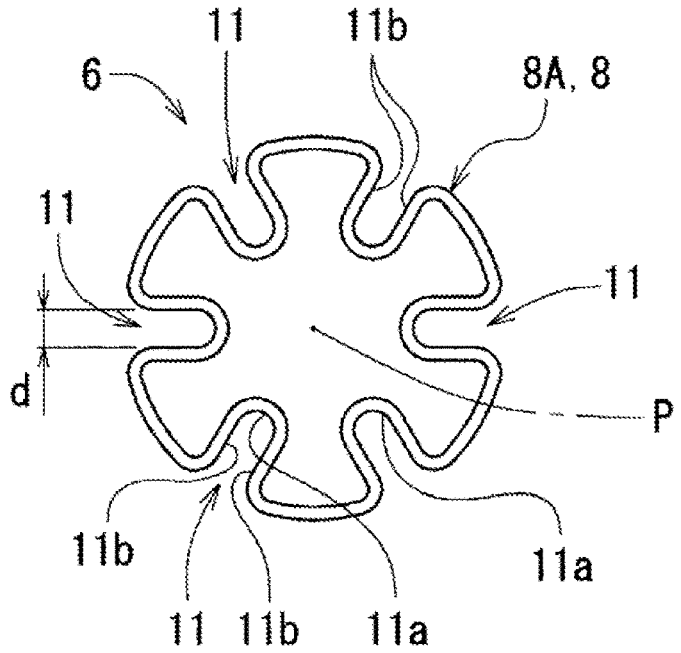
FIGS. 4A and 4B illustrate respective parts of the EGR pipe, namely.

As shown in FIG. 3 and FIG. 4A, the deformed pipe portion 8A includes deep groove portions 11, which are largely recessed at an outer peripheral surface of the deformed pipe portion 8A and extended as a band shape in an axial P direction, formed at a plurality of positions (six positions) in a circumferential direction. With the deep groove portion 11 having a long length, a surface area of the EGR pipe 6 can be largely increased, compared to a pipe having a simple circular section.

The deep groove portion 11 includes a groove bottom surface 11*a*, and a pair of left and right groove side surfaces 11*b*, 11*b*. The deep groove portion 11 is recessed with a groove width d having a constant width, to the groove bottom surface 11*a* having a depth of a half of the radius of the base pipe portion 8.

Figure 4B:
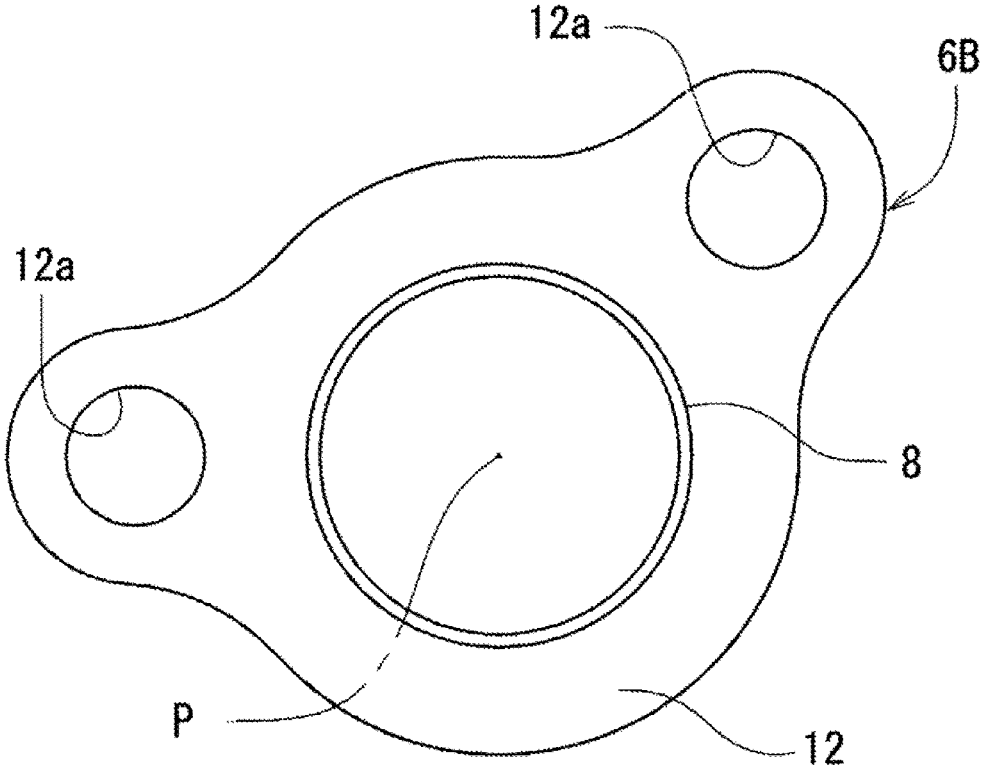

As shown in FIG. 3 and FIG. 4B, the mount flange 6B is formed by a body flange 12 of a thick plate including mount holes 12*a*, 12*a* at a plurality of portions (two positions) in an outer circumferential portion. The mount flange 6B is integrally fixed to the end portion of the main pipe 6A by welding or the like, at an opening side of the base pipe portion 8. As shown in FIG. 3, the mount flange 6B is mounted at a portion slightly moved toward an inner side from an end of the base pipe portion 8. It is preferable that each of the main pipe 6A and the mount flange 6B is formed of an aluminum alloy having small specific heat capacity, excellent heat conductivity, and high strength; however, each of the main pipe 6A and the mount flange 6B may be formed of other metal material. In a case in which each of the main pipe 6A and the mount flange 6B is formed of an aluminum alloy, an advantage in which the main pipe 6A and the mount flange 6B have corrosion resistance similar to those formed of SUS and are available in low in cost can be obtained.

Figure 5:
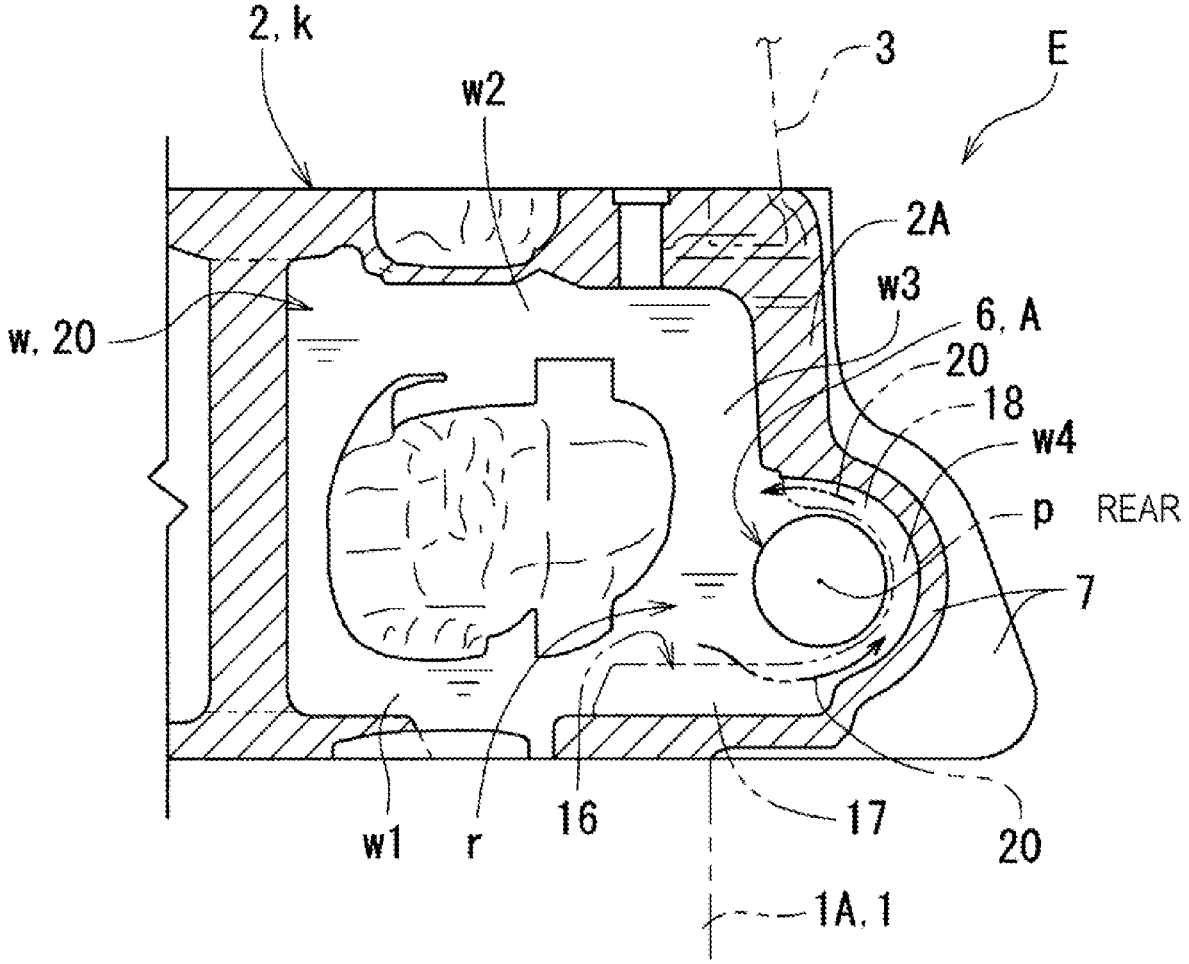
FIG. 5 is a schematic view illustrating a sectional structure of the end portion of the cylinder head seen from a lateral direction.

As shown in FIG. 1, FIG. 2, and FIG. 5, the EGR pipe 6 is arranged to pass through an inside of the expanded case portion 7 of the cylinder head 2. A most part of the EGR pipe 6 housed in the expanded case portion 7 is arranged to face a cooling water path w in the cylinder head 2. Here, the expanded case portion 7 is formed by expanding a lower portion of the case end portion 2A (one example of partially expanded) to an outer side in a semicircular shape (see FIG. 5).

The EGR pipe 6 is, for example, inserted into an attachment hole 19 formed in the side wall 2B (right side wall) at a side of the intake manifold 5 of the cylinder head 2 so that the small diameter portion 9 is pressed into or fitted into a gas intake port 15 formed as a circular hole formed in the side wall 2C (left side wall) at a side of the exhaust manifold 4 of the cylinder head 2, and the mount flange 6B is mounted to a side surface 2*a* of the cylinder head 2 at a side of the intake manifold 4 by two bolts (not shown). In this case, a diameter of the attachment hole 19 is slightly larger than a diameter of the gas intake port 15.

As shown in FIG. 1, FIG. 2, and FIG. 5, a cooling water path w in the cylinder head 2 includes a lower water path w1 located at a lower portion of the cylinder head 2, an upper water path w2 located at an upper portion of the cylinder head 2, an end water path w3 located at an end portion of the cylinder head 2, and an outer peripheral water path w4 formed at an outer peripheral side of the EGR pipe 6 in the expanded case portion 7. With the outer peripheral water path w4, the cooling water path w is formed to surround the EGR pipe 6. That is, the EGR pipe 6 is arranged to face cooling water path, so that the EGR cooling mechanism r is formed.

A case end portion 2A formed by an end portion of the engine case k is partially expanded to an outer side, and the EGR pipe 6 is arranged in an expanded portion 7 of the case end portion 2A expanded toward the outer side. The cooling water path w is formed to surround the EGR pipe 6.

The engine case k includes a guide portion 16 that guides cooling water in a portion of the EGR pipe 6 at an outer side in a radial direction, in the cooling water path w. The EGR pipe 6 is formed of an aluminum alloy, the engine case k is defined by a cylinder head 2.

As shown in FIG. 6, with the EGR device A, an exhaust gas G from a combustion chamber (not shown) is discharged into the exhaust manifold 4 from an exhaust outlet 13 of the cylinder head 2, and a part of the exhaust gas G is turned into an EGR gas g. The EGR gas g is entered into the gas intake port 15 (see FIG. 1 and FIG. 2) of the cylinder head 2 from an exhaust port 14 and then returned into the intake manifold 5 through the EGR pipe 6. A part of the EGR pipe 6 in the cylinder head 2 corresponds to the base pipe portion 8, the tapered pipe portion 10, and a part of the small diameter portion 9 recognized from FIG. 1 and the like. A main part of the EGR pipe 6 in the cylinder head 2 corresponds to the base pipe portion 8.

Since the EGR pipe 6 is housed in the expanded case portion 7, an expanded amount of the cylinder head 2 to the outer side can be reduced (suppressed) compared to a conventional EGR device in which the EGR pipe is arranged as other component at an outer side of the cylinder head. In addition, as shown in FIG. 1 and FIG. 5, since the outer peripheral water path w4 is arranged at an outer periphery of the EGR pipe 6 at an expanded side in the expanded case portion 7, a function of an EGR cooler cooled by cooling water 20 that flows in the outer peripheral water path w4, the end water path w3, and the lower water path w1 can be obtained efficiently.

Accordingly, with the EGR device A and the EGR cooling mechanism r adopting the improved structure in which the EGR pipe is housed in a portion of the cylinder head 2 slightly expanded, the engine E with the EGR device capable of cooling the EGR gas g by using the existing cooling water 20 effectively and capable of reducing the size in a lateral direction of the engine can be obtained. Since the EGR gas g can be effectively cooled in the EGR pipe 6, an external EGR cooler (not shown) can be advantageously omitted.

As shown in FIG. 1, FIG. 2, and FIG. 5, it is preferable to arrange a guide portion 16 (illustrated by a solid line in FIG. 1 and FIG. 2, and a virtual line in FIG. 5), which guides the cooling water 20, in a portion of the EGR pipe 6 at an outer side in a radial direction, in the cooling water path w. The guide portion 16 includes a guide body 17 protruded into the lower water path w1 at a lower portion of the EGR pipe 6, and a circumferential guide portion 18 protruded into a half of the outer peripheral water path w4 so as to surround a half of the EGR pipe 6. Further, the guide portion 16 may be formed by molding.

The cooling water 20 flowing the cooling water path w is promoted to flow into the outer peripheral water path w4 by arranging the guide portion 16. Consequently, a water cooling effect of the EGR pipe 6 (EGR gas g) by using the cooling water can be advantageously enhanced with an economical measure (guide portion 16) hardly increasing a cost.

OTHER EMBODIMENTS

The engine with the EGR device may have each of the following configurations (1) to (5).

(1) The EGR pipe 6 may be formed by a general pipe having a simple circular section or a simple rectangular section without the deep groove portion 11. In this case, the gas intake port 15 and the attachment hole 19 of the cylinder head 2 may be formed in the same diameter.

(2) The outer peripheral surface of the EGR pipe 6 with which the cooling water path w is contacted may be formed to face the cooling water path w not at the whole outer peripheral surface (360 degrees) but at a partial surface of ¾ (270 degrees) or a half (180 degrees) of the outer peripheral surface.

(3) The EGR device A may be formed such that the EGR pipe 6 is housed in an upper end portion of the cylinder portion 1A. In this case, the EGR pipe 6 receives the water cooling effect from the cooling water path of the cylinder portion 1A.

(4) The intake path 5 may be variously formed such as an intake side of an air cleaner or a supercharger other than the intake manifold 5.

What is claimed is:

1. An engine with an EGR device comprising:

an engine case; and an EGR pipe that introduces an EGR gas into an intake path, the EGR pipe being arranged to pass through an inside of the engine case, wherein a part of the EGR pipe in the engine case is arranged to face a cooling water path in the engine case, a case end portion formed by an end portion of the engine case is partially expanded to an outer side, the EGR pipe is arranged in an expanded portion of the case end portion expanded toward the outer side, the cooling water path includes a lower water path located at a lower portion of the engine case and an outer peripheral water path formed at an outer periphery of the EGR pipe at an expanded side, the engine case is provided with a guide portion, which guides cooling water, in a portion of the EGR pipe at an outer side in a radial direction, in the cooling water path, and the guide portion includes a guide body protruded into the lower water path at a lower portion of the EGR pipe, and a circumferential guide portion protruded into a half of the outer peripheral water path so as to surround a half of the EGR pipe.

2. The engine with the EGR device according to claim 1, wherein the cooling water path is formed to surround the EGR pipe.

3. The engine with the EGR device according to claim 2, wherein the EGR pipe is formed of an aluminum alloy.

4. The engine with the EGR device according to claim 1, wherein the EGR pipe is formed of an aluminum alloy.

5. The engine with the EGR device according to claim 1, wherein the engine case is defined by a cylinder head.

* * * * *